US007527538B2

(12) United States Patent
Mizutani

(10) Patent No.: US 7,527,538 B2
(45) Date of Patent: May 5, 2009

(54) TOE ADJUSTMENT FOR SMALL BOAT HAVING MULTIPLE PROPULSION UNITS

(75) Inventor: Makoto Mizutani, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 85 days.

(21) Appl. No.: 11/534,152

(22) Filed: Sep. 21, 2006

(65) Prior Publication Data

US 2007/0207683 A1 Sep. 6, 2007

(30) Foreign Application Priority Data

Sep. 21, 2005 (JP) ..... 2005-273059

(51) Int. Cl.
*B63H 5/125* (2006.01)
*B63H 21/22* (2006.01)
*B60L 3/00* (2006.01)

(52) U.S. Cl. ..... 440/61 S; 440/1; 701/21

(58) Field of Classification Search ..... 440/61 R
See application file for complete search history.

(56) References Cited

U.S. PATENT DOCUMENTS 6,994,046 B2 * 2/2006 Kaji et al. ..... 114/144 R
6,997,763 B2 2/2006 Kaji
7,063,030 B2 * 6/2006 Mizutani ..... 114/144 R
7,153,174 B2 12/2006 Takada et al.
7,267,068 B2 9/2007 Bradley et al.
2005/0263058 A1 12/2005 Suemori et al.
2006/0014447 A1 1/2006 Okuyama
2006/0037522 A1 2/2006 Kaneko et al.
2006/0240720 A1 10/2006 Yamashita et al.
2007/0068438 A1 3/2007 Mizutani

FOREIGN PATENT DOCUMENTS

JP 01-285486 11/1989
JP 01-314695 12/1989
JP 04-038297 2/1992

* cited by examiner

*Primary Examiner*—Jesus D Sotelo
(74) *Attorney, Agent, or Firm*—Knobbe, Martens, Olson & Bear, LLP

(57) ABSTRACT

A small boat has multiple propulsion units. A toe angle of the multiple propulsion units can be altered while the boat is under way. The toe angle can be adjusted to improve performance in any of a number of areas, including top speed, acceleration, fuel economy, and maneuverability, at the demand of the operator.

14 Claims, 9 Drawing Sheets

TOE ADJUSTMENT FOR SMALL BOAT HAVING MULTIPLE PROPULSION UNITS

CROSS-REFERENCE TO RELATED APPLICATIONS

This application claims the priority benefit of Japanese Patent Application No. 2005-273059, filed Sep. 21, 2005, which is hereby incorporated by reference in its entirety.

BACKGROUND OF THE INVENTION

1. Field of the Invention

The present invention generally relates to small boats comprising multiple propulsion units, such as outboard motors or stern-drives (hereinafter inclusively referred to as outboard motor), mounted at the stern.

2. Description of the Related Art

With reference initially to FIGS. 8(A) to 8(C), toe angle will be described. As shown in FIG. 8(A), two outboard motors 3*a*, 3*b* are installed on a transom plate 2 of a hull 1. The outboard motors 3*a*, 3*b* are installed in a non-parallel configuration with the distance between the rearward portions of the outboard motors being shorter than the distance between the forward portions of the outboard motors. The toe angle refers to the angle theta (θ) defined between two outboard motors 3*a*, 3*b* that have been installed in a non-parallel, symmetrically diverging configuration relative to each other. Therefore, when the boat is in the neutral position (i.e., the straight-ahead running position), the turning angle (the angle relative to the axis perpendicular to the transom plate 2) for each of the outboard motors 3*a*, 3*b* is θ/2.

FIG. 8(B) illustrates a relationship between toe angle and acceleration time. As shown, the acceleration time changes depending on the toe angle. It is believed that there is a toe angle θ1 at which the maximum acceleration performance can be attained (i.e., a toe angle at which the boat reaches a desired speed in the shortest time).

FIG. 8(C) illustrates a relationship between toe angle and top speed. As shown, the top speed changes depending on the toe angle. It is believed that there is a toe angle θ2 at which the highest top speed can be attained (i.e., a toe angle providing the highest speed).

As described above, a toe angle exists that can optimize performance, whether the performance is acceleration time or top speed. In the case of conventional small boats featuring multiple outboard motors, the toe angle of the symmetrically diverged outboard motors is adjusted on land, generally prior to the shipment from the factory, to a predetermined fixed value (generally 1 degree or less), and the fixed toe angle is maintained while the boat is under way. In other words, each of the outboard motors 3*a*, 3*b* is held at a certain angle relative to another outboard motor (in practice, the angular deviation is so small that they are almost in parallel with each other) and is steered by steering wheel operation generally without changing the toe angle in the neutral position.

FIGS. 9(A) and 9(B) illustrate changes in the orientation of the outboard motors while the boat is under way. In a boat, propeller reaction force is exerted on an outboard motor due to the rotation of the propeller, and the biasing force called "paddle-rudder effect" or "gyroscopic effect" is generated, which changes the orientation of the outboard motor to make the boat proceed while angled in certain direction. As shown in FIGS. 9(A) and 9(B), an outboard motor 3 is coupled to a steering device 15 mounted on a transom plate 2 via a steering bracket 5. The outboard motor 3 turns around a swivel shaft 6 when the steering wheel is moved to cause a steering movement.

While the boat is running straight ahead with the steering handle kept at its neutral position, the propeller reaction force (F) is exerted to apply biasing force to the outboard motor 3 and changes the orientation of the outboard motor 3. FIG. 9(A) indicates the boat running at lower speeds. In this case, the propeller reaction force (F) is small, and thus the directional displacement θ of the outboard motor 3 is small. FIG. 9(B) indicates the boat running at higher speeds or running with a heavy load. In this case, the propeller reaction force (F) is large, and thus the directional displacement θ of the outboard motor 3 is large.

In reality, an anti-vibration rubber mount is interposed between the outboard motor and the steering device. Consequently, even when the steering device is moved to attain the target turning angle that corresponds to the steering wheel operation, the actual direction of the propulsive force differs slightly from the target turning angle due to the elastic deformation of the anti-vibration rubber mount caused by the propeller reaction force. The directional deviation of the propulsive force differs depending on the speed, load, propeller configuration and water pressure.

JP-B-2959044 disclosed an electric steering device that was used on a small boat. The electric steering device uses an electric motor to cause the steering action in place of the hydraulic mechanism. Smooth operation and highly accurate controllability are obtained by using the electric steering device. Another power steering configuration is disclosed in JP-B-2739208. In this configuration, steering of the single outboard motor is assisted with an electric motor. However, the disclosed constructions do not discuss the relative angle of left and right outboard motors that are symmetrically positioned.

In the conventional symmetrical installation of multiple outboard motors to a single watercraft, the mounting angle adjustment procedure includes linking both of the outboard motors with a tie bar and altering the tie bar length to provide the appropriate relative angle between the outboard motors. However, the conventional mounting angle adjustment procedure must be performed on land after the boat operation is stopped and the hull is out of the water. In addition, once the adjustment is made and the toe angle is fixed, the boat must be operated without further modifications. In other words, the mounting angle cannot be adjusted on the water while the boat is under way.

SUMMARY OF THE INVENTION

In view of the drawbacks discussed above, one embodiment of the present invention seeks to provide a small boat having multiple outboard motors in which the toe angle of multiple outboard motors can be adjusted while the boat is under way such that the toe angle can be provided that allows optimized performance in top speed, acceleration, fuel economy, or maneuverability as desired by the operator.

Thus, one aspect of an embodiment of the present invention involves a small boat comprising a plurality of propulsion units mounted at a stern. A toe angle altering apparatus is connected to the plurality of propulsion units. The toe angle altering apparatus is adapted to alter a toe angle of the plurality of propulsion units while the small boat is under way. A running state detecting apparatus is mounted to the boat and a toe angle control unit is connected to the toe angle altering apparatus. The toe angle control unit determines a target toe angle corresponding to a running state detected by the running state detecting apparatus and drives the toe angle altering apparatus to attain the target toe angle.

An aspect of another embodiment of the present invention involves a small boat comprising a hull with a transom wall defining a portion of the hull. A first propulsion unit is mounted to the transom wall and a second propulsion unit is mounted to the transom wall. The first and second propulsion units are mounted generally parallel. The first and second propulsion units are steerable relative to the transom wall. A running state detecting apparatus is mounted to the small boat. The running state detecting apparatus is adapted to sense an operating characteristic of the small boat. The running state detecting apparatus provides data to a controller. The controller provides control signals to a steering device associated with at least one of the propulsion units. The steering device is adapted to adjust a toe angle of the associated propulsion device in accordance with control signals from the controller that are based upon the data provided to the controller by the running state detecting apparatus.

BRIEF DESCRIPTION OF THE DRAWINGS

These and other features, aspects and advantages will now be described with reference to drawings of a preferred embodiment. The drawings comprise the following figures.

DETAILED DESCRIPTION OF THE PREFERRED EMBODIMENT

Figure 1:
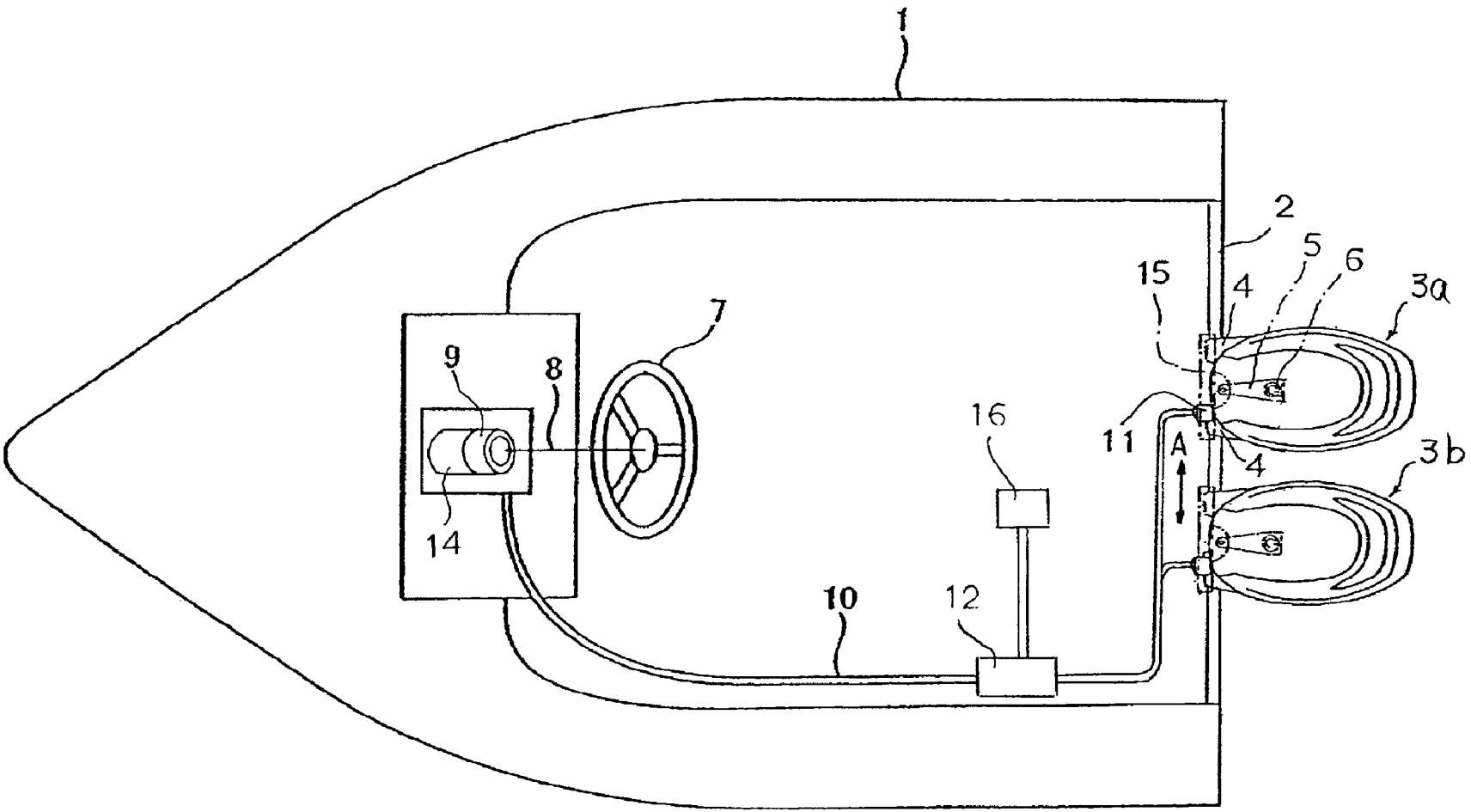
FIG. 1 is an overall top plan view of a small boat that is arranged and configured in accordance with certain features, aspects and advantages of the present invention.

FIG. 1 is a plan view of a small boat comprising a twin installation of outboard motors. In the illustrated embodiment, the twin outboard motor installation is merely an example. Other numbers of multiple outboard motors, including but not limited to triple and quadruple motor installations, also can benefit from certain features, aspects and advantages of the present invention.

Figure 3:
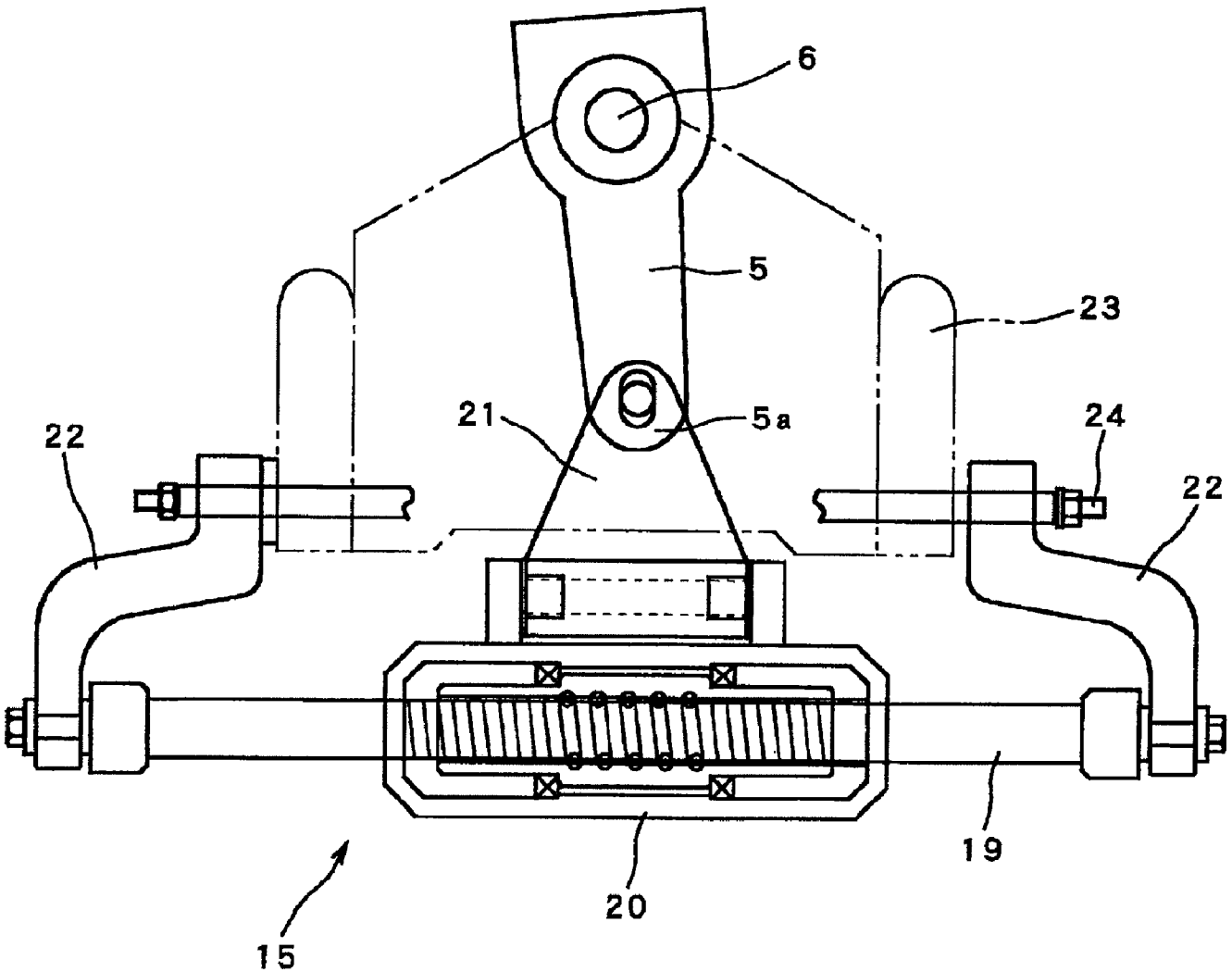
FIG. 3 is a configuration view of a steering device that is arranged and configured in accordance with certain features, aspects and advantages of the present invention.

With reference to the embodiment of FIG. 1, two outboard motors 3*a*, 3*b* are installed on a transom plate 2 of a hull 1 via a clamp bracket. The outboard motors 3*a*, 3*b* can rotate around a swivel shaft 6 (e.g., a vertical shaft). A steering bracket 5 is fixed to the upper end of the swivel shaft 6. A steering device 15 that preferably is operated by an electric motor (see FIG. 3) can be coupled to a forward portion of the steering bracket 5. When the electric motor causes the steering device 15 to move in the direction of arrow A, the outboard motors 3*a*, 3*b* rotate around the swivel shafts 6 via the steering brackets 5 in accordance with the turning angle caused by the movement of the steering device 15. Each of the outboard motors 3*a*, 3*b* and the steering device 15 can be connected to a control unit (ECU) 12 via a controller 11 so that the control unit 12 can control the outboard motor engine output and the turning angle of the steering device 15.

A steering wheel 7 is provided proximate the operator's seat. The steering angle resulting from rotation of the steering wheel 7 is detected by a steering angle sensor 9 by way of the steering wheel shaft 8. Other configurations also can be used. The detected steering angle information is transmitted to the control unit 12 by way of a cable 10. Other arrangements, including wireless communication, also can be used. The steering wheel shaft 8 is coupled to a reaction force motor 14. Reaction torque is calculated by the control unit 12 in accordance with the steering angle and the external force being exerted. The reaction torque obtained by the calculation is imposed on the steering wheel 7 by the reaction force motor 14. In this way, the reaction force is applied in response to the steering wheel operation that depends on the running state of the boat. Thus, the operator can have the operating feeling such as heavy-load feeling or light-load feeling while operating the steering wheel.

The control unit 12 can be connected to a running state detecting apparatus 16. In one embodiment, the running state detecting apparatus 16 includes one or more of a speed sensor, an attitude sensor, a yaw rate sensor, a lateral acceleration sensor, an engine condition sensor, a shift position sensor, and an acceleration sensor. The speed detection by the speed sensor may be carried out by directly detecting the speed through the water with an impeller provided at the bottom of the hull, or by calculating the speed over the ground based on the positional data obtained by the GPS. Alternatively, the speed may be estimated based on the engine speed and the throttle opening. Other configurations also can be used. The attitude sensor detects the attitude of the boat by sensing the rolling angle and/or the pitching angle of the hull with a gyroscope or other appropriate devices. The yaw rate sensor detects the turning status of the boat. The lateral acceleration sensor detects the centrifugal force generated while the boat is making a turn. The engine condition sensor detects the throttle opening and/or the engine speed. The shift position sensor detects the shifting position (e.g., whether the transmission is in forward or in reverse). The acceleration sensor detects the throttle opening based on the acceleration lever status. Other arrangements also can be used to detect the acceleration status. As additional running state data, the acceleration state may be obtained by calculation based at least in part on the speed data. Also, the external force exerted on the hull during turning may be detected by a load sensor provided on the steering device of each outboard motor. The external force may be detected by a torque sensor provided on the motor of the steering device. Further, the outboard motor thrust may be detected as running state data by a torque sensor provided on the engine output shaft or the propeller shaft of each outboard motor. The running state of the boat is detected by any or all of the running state detecting apparatus 16 as described above, and the detected running state data preferably are transmitted to the control unit 12.

Figure 2:
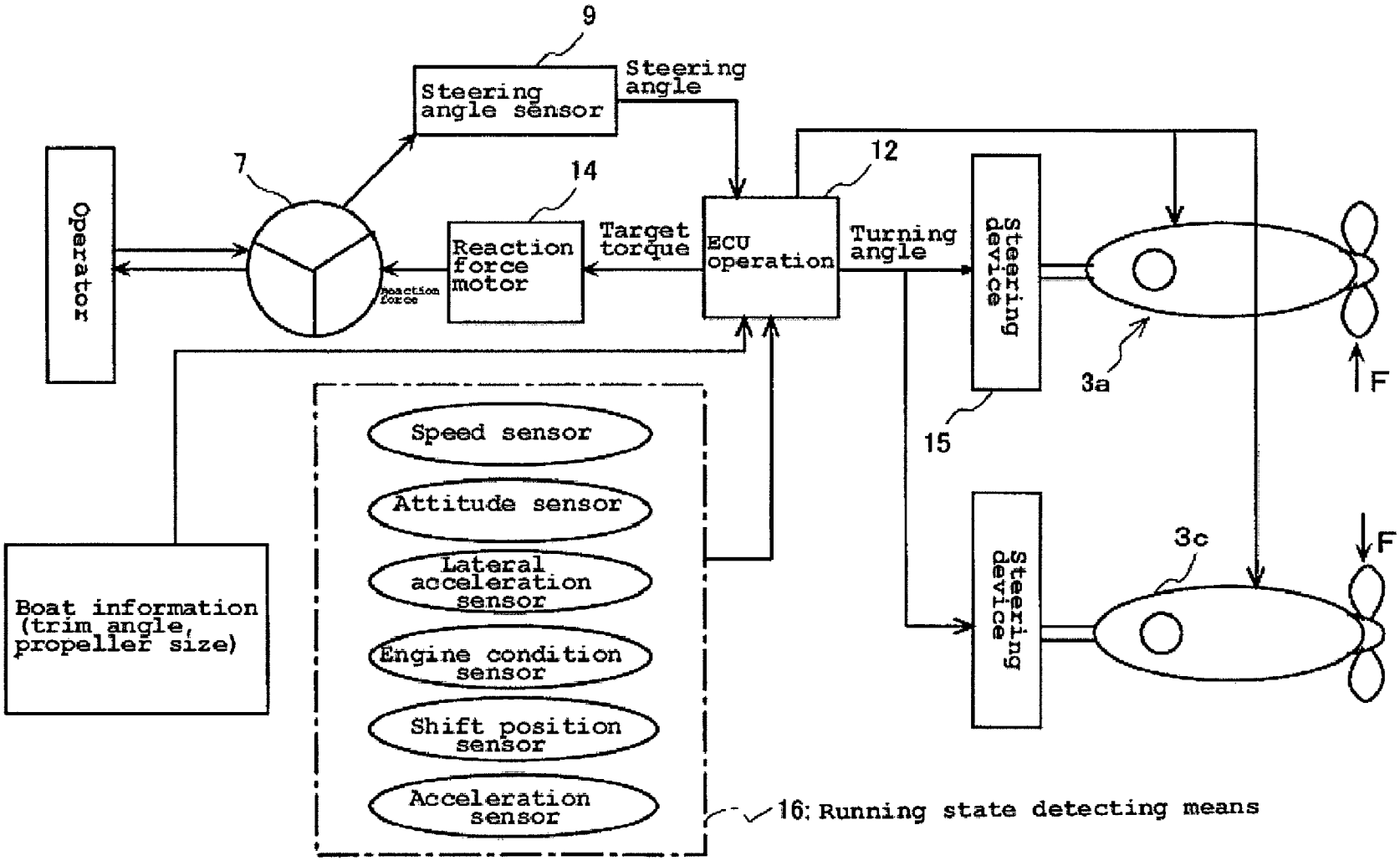
FIG. 2 is a block diagram showing several major components of a steering control system used in the small boat of FIG. 1.

With reference now to FIG. 2, an embodiment of a steering control system for the small boat of FIG. 1 is shown in block diagram form. The block diagram shows the major components of the steering control system.

The rotational angle of the steering wheel 7 is detected by the steering angle sensor 9, or another suitable component, and the steering angle data is input to the control unit 12. The detected running state data described above also is input to the control unit 12. The control unit 12 calculates the target torque for the reaction force to be imposed on the steering wheel based on the steering angle data and the running state data. Then, the reaction force is exerted on the steering wheel 7 by driving the reaction force motor 14.

Information, including trim angle and propeller size, also can be input to the control unit 12.

The two outboard motors 3*a*, 3*b* in the illustrated configuration are installed on the transom plate 2 (see FIG. 1) of the hull. The steering device 15 on each of the outboard motors 3*a*, 3*b* can be connected to the control unit 12. Once a turning angle value command is received from the control unit 12, the steering device 15 drives the electric motor (not shown) to create steering motion. The control unit 12 also can be connected to the engine (not shown) of each of the outboard motors 3*a*, 3*b* such that the control unit 12 can adjust the engine throttle opening, the fuel injection amount and/or time and the ignition timing to control the output of each outboard motor.

An electric motor 20, which forms at least a portion of the steering device 15 in one embodiment, can be a DD (Direct Drive) type motor that is mounted to a threaded rod 19 for sliding along the threaded rod 19. Both ends of the threaded rod 19 preferably are fixed to the transom plate (not shown) with a supporting member 22. The supporting member 22 can be connected to a clamping portion 23 of the clamp bracket with a tilting shaft 24.

The steering bracket 5 can be secured to the swivel shaft 6 on each of the outboard motors 3*a*, 3*b*, with the electric motor 20 being coupled to a forward portion 5*a* of the illustrated steering bracket 5 via a coupling bracket 21. In this configuration, sliding motion of the electric motor 20 along the threaded rod 19 in accordance with the magnitude of the desired steering action (i.e., the turning angle of the steering wheel) can cause the outboard motor to be steered by rotating around the swivel shaft 6.

The electric steering device 15 can be provided on each of the outboard motors 3*a*, 3*b* and the electric steering devices 15 are used to alter the relative angular position of the outboard motors (i.e., toe angle) when they are in a neutral position (i.e., straight ahead operation) depending upon the running state while the boat is under way. The steering motion equivalent to the magnitude of steering wheel operation then can be implemented with the altered toe angle.

Figure 4:
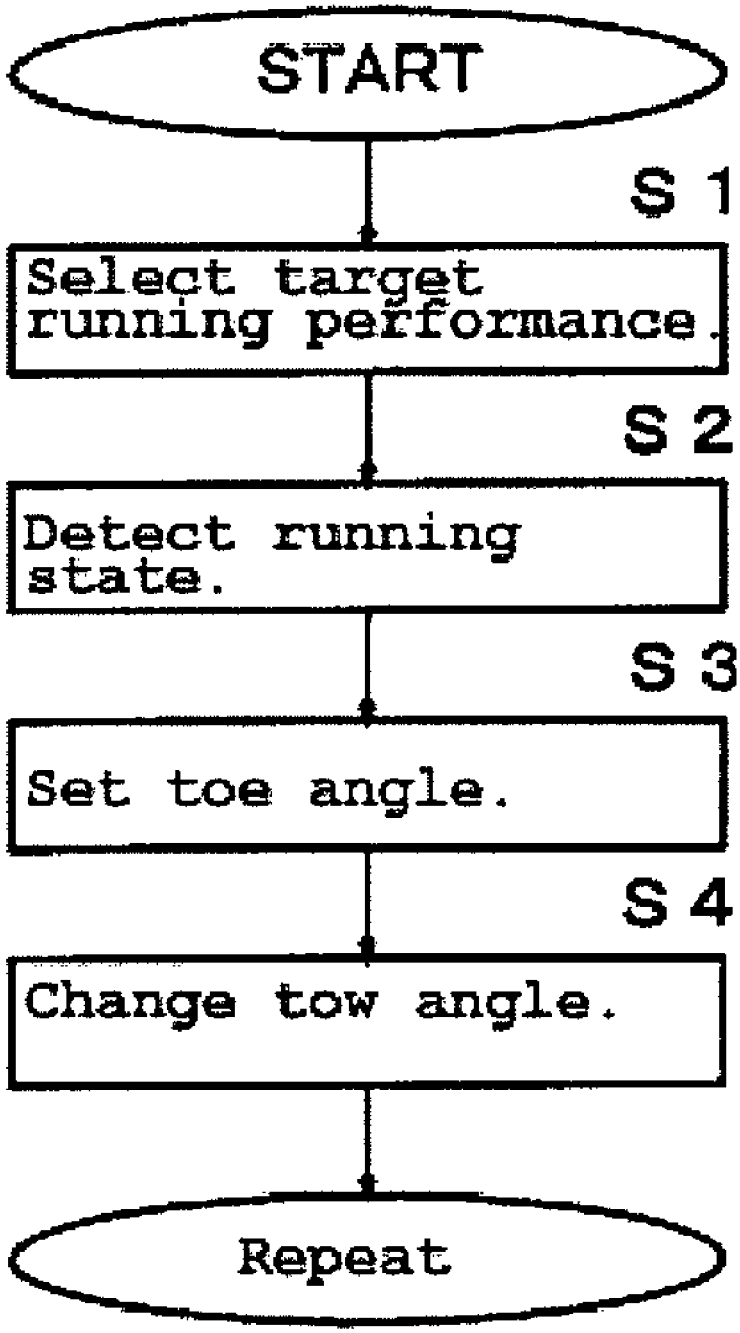
FIG. 4 is a flowchart of a toe angle determination process that is arranged and configured in accordance with certain features, aspects and advantages of the present invention.
Figure 8:
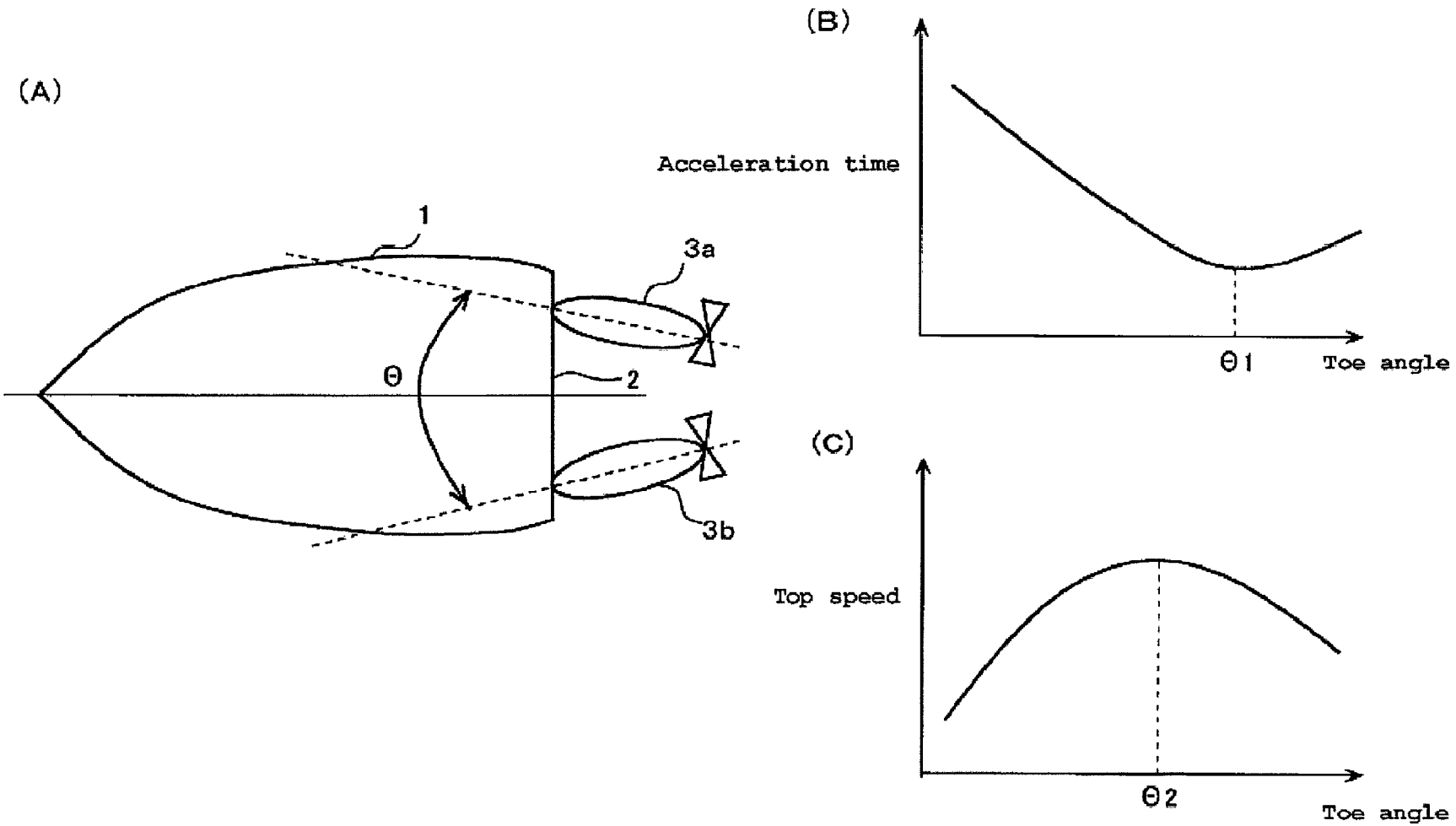
FIGS. 8(A) to 8(C) illustrate the relationship between toe angle and running performance.
Figure 9:
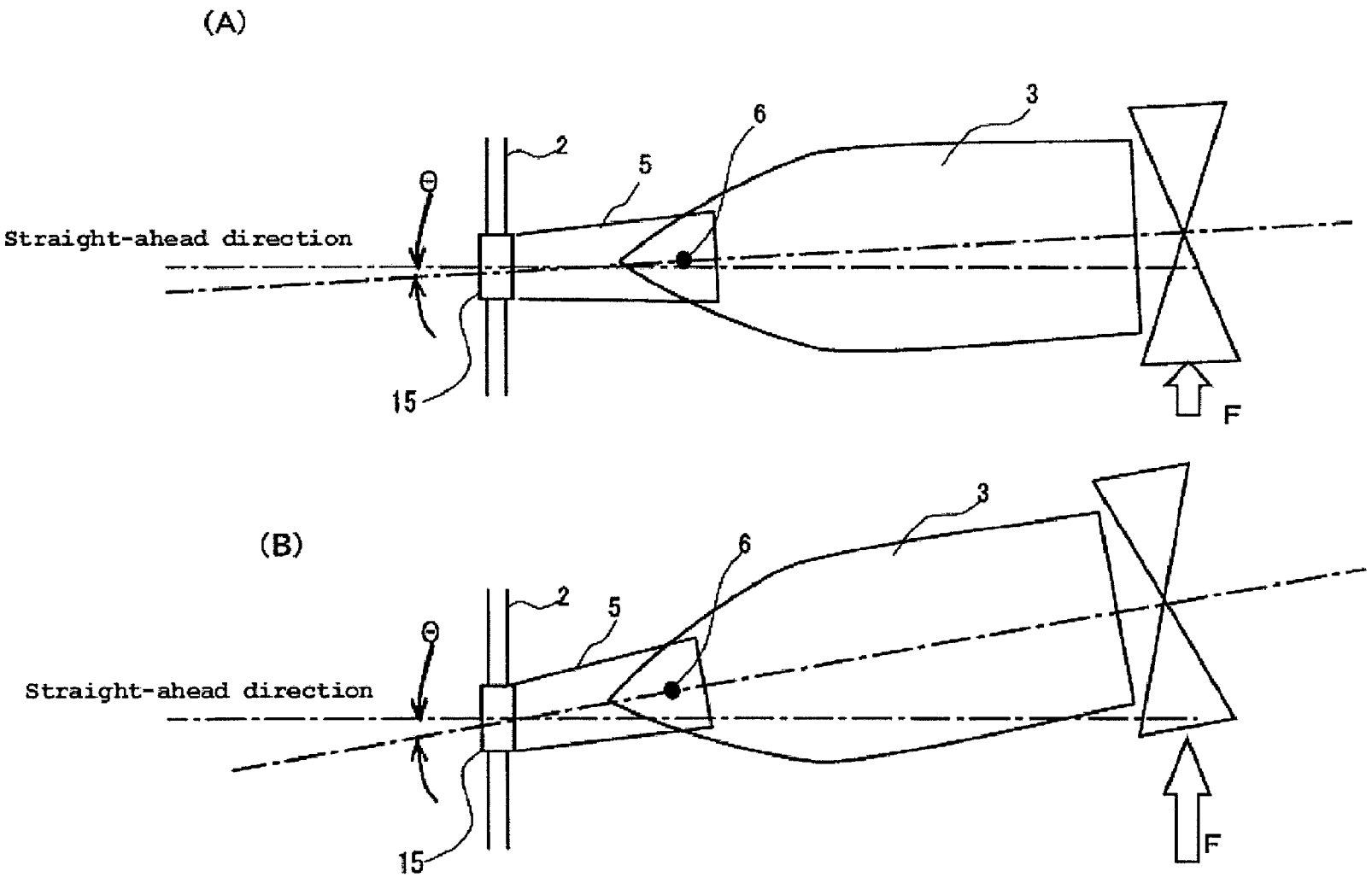
FIGS. 9(A) and 9(B) illustrate propeller reaction forces exerted on outboard motors.

With reference now to FIG. 4, one embodiment of the toe angle alteration process is presented in a flow chart format. The target running performance mode preferably is selected (S-1). In selecting the target running performance mode, the operator identifies which operating characteristic should be prioritized. In other words, the target running performance mode signifies the running performance that the operator designates as the highest priority among the various running performance modes. In one configuration, running performance modes can include top speed performance (i.e., the performance to attain the highest possible top speed); acceleration performance (i.e., the performance to accelerate in the short period of time); fuel economy performance (i.e., the performance to make the fuel consumption as little as possible); and maneuverability (i.e., the performance that allows increased stability and reliability when turning the boat). For instance, the target running performance mode can be selected using a running performance mode selecting switch and the operator can select the target running performance mode by movement of the selecting switch. As described above (see FIG. 8), there exists a toe angle for each running performance mode that can maximize the relevant running performance. While each of the toe angles is different for each mode, it is possible that more than one mode will be optimized at a single toe angle in some configurations.

Once the operator selects the mode, the running state is detected (S-2). The running state such as speed, acceleration, and engine operation state can be detected by the running state detecting apparatus 16 (FIG. 1).

The target toe angle then is determined by the control unit 12 (S-3) or in any other suitable manner. The target toe angle is determined based on the selected target running performance mode, the detected running state, and other boat information, such as trim angle and propeller size (see FIG. 2). The target toe angle may be determined using a predefined map (see FIG. 5) or the target toe angle can be determined in any other suitable manner.

Figure 6:
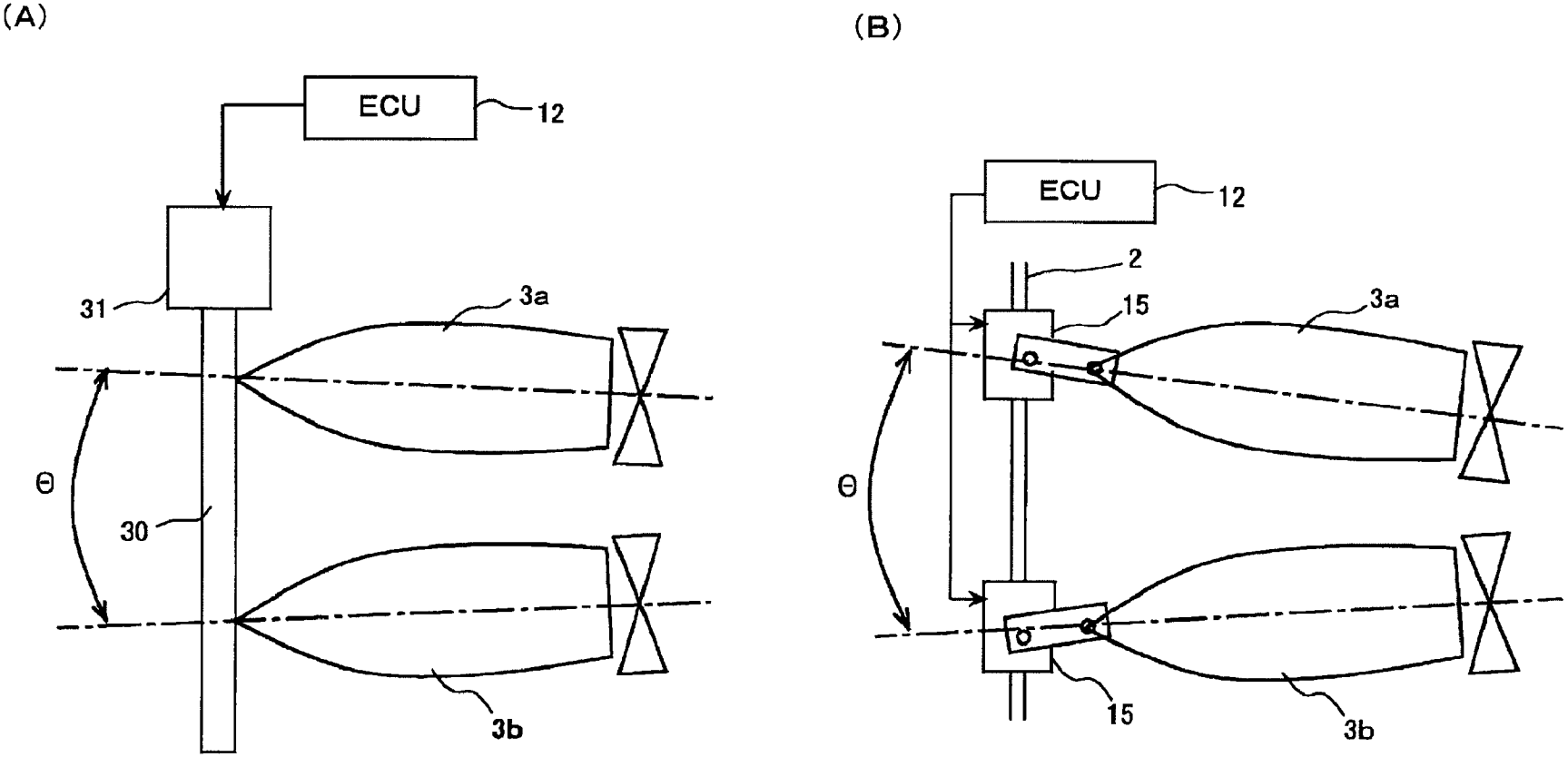
FIGS. 6(A) and 6(B) are illustrations of toe angle altering apparatus that are arranged and configured in accordance with certain features, aspects and advantages of the present invention.

The toe angle then is altered (S-4) until it substantially matches the predetermined target toe angle. In this step, the toe angle is altered automatically by driving the electric motor or other toe angle altering apparatus (see FIG. 6) based on the command from the control unit 12. Other configurations also can be used.

Figure 5:
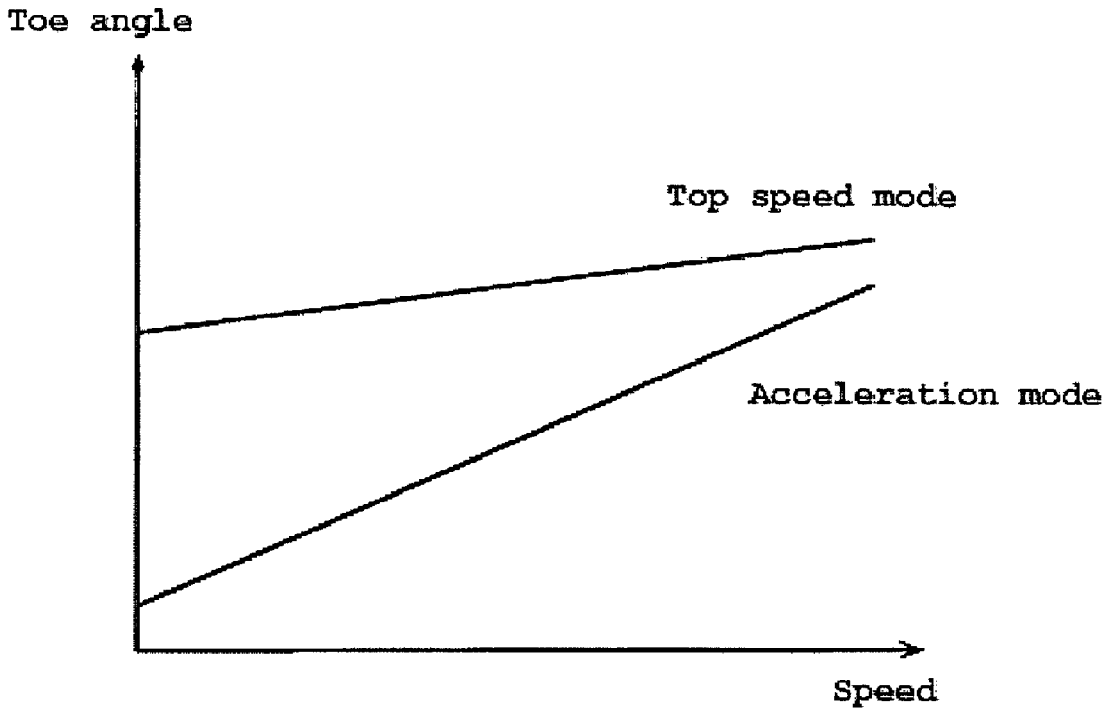
FIG. 5 is an illustration of two running performance modes as a function of speed and toe angle.

FIG. 5 provides a simplified example of a map for determining the target toe angle. As illustrated, the map shows top speed mode and acceleration mode as a function of toe angle and speed. This is used when the target running performance mode is set at the top speed mode or at the acceleration mode. Once the target running performance mode is selected, the map allows the determination and implementation of the most appropriate toe angle for the relevant speed based on the speed data.

FIGS. 6(A) and 6(B) indicate two configurations of toe angle altering apparatus. As shown in FIG. 6(A), a driving device 31 can adjust the length of a tie bar 30 that connects both of the outboard motors 3*a*, 3*b* to alter the toe angle θ. This process determines the toe angle at the neutral position, and maintains the toe angle while the turning motion is implemented to correspond to the steering wheel operation. In other words, the angle of the outboard motors 3*a*, 3*b* will be determined by combining the target toe angle and the requested movement of the outboard motor 3*a*, 3*b* as indicated by the steering wheel operation.

FIG. 6(B) illustrates a configuration in which the electric steering device is used to alter the toe angle. When the target toe angle is set at θ, this configuration gives the turning angle of θ/2 to each of the outboard motors 3*a*, 3*b* in the opposite direction with each other. Thus, the toe angle θ can be obtained at the neutral position. A variation of this configuration may be used depending upon whether or not the outboard motors are set up for counter-rotating propellers.

Figure 7:
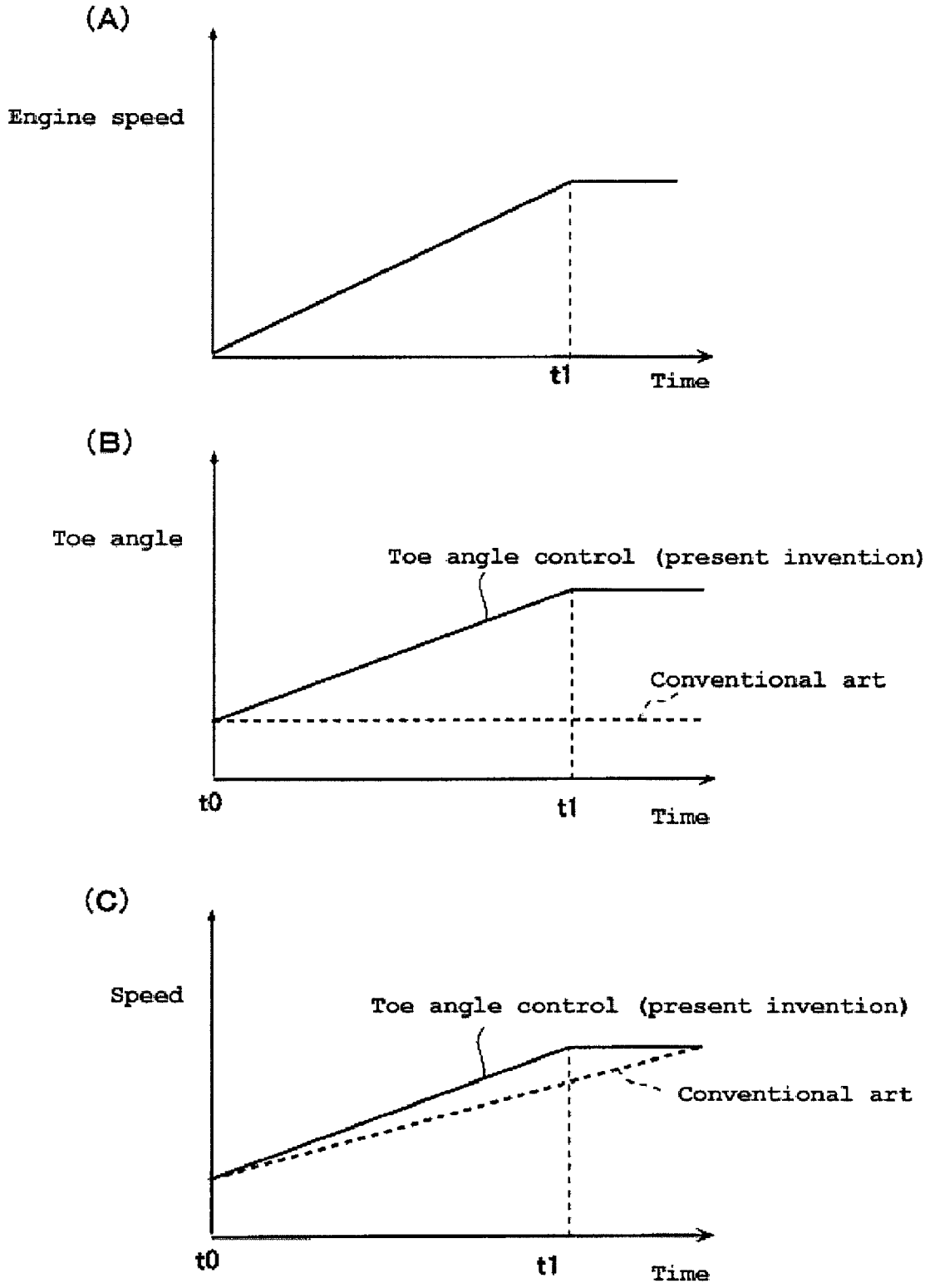
FIGS. 7(A) to 7(C) are graphical depictions of the efficacy of the toe angle control that is arranged and configured in accordance with certain features, aspects and advantages of the present invention.

FIGS. 7(A) to 7(C) illustrate the efficacy of the toe angle control that is arranged and configured in accordance with an embodiment of the present invention. FIG. 7(A) shows the engine speed relative to the elapsed time and, in particular, shows an increases speed over time (i.e., the watercraft is accelerating). In the illustrated depiction, a predetermined engine speed is reached at the time t1, beyond which the engine speed is kept generally constant.

FIG. 7(B) shows the toe angle increasing proportionally relative to the engine speed and, in particular, the toe angle increases from time t0 to time t1. The dashed line exemplifies conventional art in which the toe angle is maintained all the time.

FIG. 7(C) shows the change in speed. Altering the toe angle in the manner shown in FIG. 7(B) allows the boat to reach top speed more quickly in comparison with the conventional art (dashed line). Thus, acceleration performance is improved.

Although the present invention has been described in terms of a certain embodiment, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A small boat comprising:

a plurality of propulsion units mounted at a stern;

a toe angle altering apparatus connected to the plurality of propulsion units, the toe angle altering apparatus being adapted to alter a toe angle of the plurality of propulsion units while the small boat is under way;

a running state detecting apparatus mounted to the boat, the running state detecting apparatus being adapted to sense an operating characteristic of the small boat;

a controller comprising a toe angle control unit connected to the toe angle altering apparatus the running state detecting apparatus providing data to the toe angle control unit;

wherein the toe angle control unit determines a target toe angle corresponding to a selected target running performance mode and the running state detected by the running state detecting apparatus, the toe angle control unit driving the toe angle altering apparatus to attain the target toe angles;

and the target toe angle determined by the toe angle control unit differing for a given running state detected by the running state detecting apparatus depending upon which of multiple target running performance modes has been selected.

2. The small boat according to claim 1, wherein each propulsion unit is steered by an electric steering device, and the electric steering device forms at least a portion of the toe angle altering apparatus.

3. The small boat of claim 1, wherein the running state detecting apparatus is selected from the group consisting of: a speed sensor, an attitude sensor, a yaw rate sensor, a lateral acceleration sensor, an engine condition sensor, a shift position sensor and an acceleration sensor.

4. The small boat of claim 1, wherein the toe angle altering apparatus defines a first steering device associated with the first propulsion unit and a second steering device is associated with the second propulsion unit.

5. The small boat of claim 1, wherein the toe angle altering apparatus comprises a direct drive electric motor.

6. The small boat of claim 5, wherein the toe angle altering apparatus further comprises a threaded rod and the direct drive electric motor translates relative to the threaded rod.

7. The small boat of claim 1 further comprising a steering input member, the steering input member positioned proximate an operator station on the small boat, the steering input member connected to the controller such that steering movement of the propulsion units requested by the operator can be transmitted to the controller.

8. The small boat of claim 7, wherein control signals transmitted to the toe angle altering apparatus combine the requested steering movement and a target toe angle that varies with changes detected by the running state detecting apparatus.

9. The small boat of claim 1, wherein the controller adjusts control signals relating to the target toe angle in accordance with a desired operating characteristic of the small boat.

10. The small boat of claim 9, wherein the desired operating characteristic is selected from the group consisting of: top speed performance, acceleration performance, fuel economy performance, and maneuverability.

11. The small boat of claim 9, wherein the control signals are varied with a detected speed of the small boat.

12. The small boat of claim 1, wherein the selected target running performance mode is selected among multiple target running performance modes and each target running performance mode adjusts the toe angle to maximize an operating characteristic of the small boat that corresponds to the selected target running performance mode.

13. The small boat of claim 12, wherein each running performance mode corresponds to an operating characteristic of the small boat and the target running performance mode is selected by selecting the desired operating characteristic of the small boat.

14. The mall boat of claim 13, wherein selecting of the target running performance mode is selected by selecting the desired operating characteristic using a selection switch.

* * * * *

UNITED STATES PATENT AND TRADEMARK OFFICE

CERTIFICATE OF CORRECTION

PATENT NO. : 7,527,538 B2
APPLICATION NO. : 11/534152
DATED : May 5, 2009
INVENTOR(S) : Makoto Mizutani It is certified that error appears in the above-identified patent and that said Letters Patent is hereby corrected as shown below:

At column 7, Line 35, in Claim 1, change “angles;” to --angle;--.

At column 8, Line 43, in Claim 14, change “mall” to --small--.

Signed and Sealed this

First Day of December, 2009

David J. Kappos

David J. Kappos
*Director of the United States Patent and Trademark Office*